United States Patent [19]

Chapman et al.

[11] 4,375,359

[45] Mar. 1, 1983

[54] WATER BASED FIRESIDE ADDITIVE

[75] Inventors: Stuart R. Chapman, Acton; F. Ross Pollard, Oakville, both of Canada

[73] Assignee: Dearborn Chemical Company Limited, Mississauga, Canada

[21] Appl. No.: 90,732

[22] Filed: Nov. 2, 1979

[51] Int. Cl.[3] ..... C10L 1/12

[52] U.S. Cl. ..... 44/51; 44/67; 431/2; 431/3; 431/4

[58] Field of Search ..... 44/51, 67; 431/2, 3, 431/4

[56] References Cited

U.S. PATENT DOCUMENTS 3,089,539 5/1963 Vermillion et al. ..... 431/4

3,120,864 2/1964 Teufel ..... 431/4

*Primary Examiner*—Jacqueline V. Howard

[57] ABSTRACT

Fireside additive is introduced into oil-fired furnace as aqueous solution via oil-water homogenizer feeding to burner.

8 Claims, No Drawings

WATER BASED FIRESIDE ADDITIVE

This invention is directed to a novel method of introducing certain fireside chemicals into an oil-fired furnace that uses a homogenizer. The additive is dissolved into the water that goes to the homogenizer. Preferably, a feed solution of additive in water is made up, and this is metered to the water fed to the homogenizer.

A large number of additives can be used in this way. They must, of course, be soluble in the amount of water used in the homogenizer.

Among the fireside additives suitable for use in this invention are the water soluble salts of Mn, Cu, Mg, Al, Fe, Pb, Zn, and mixes thereof. The sulfates of most of these elements are soluble and generally commercially available. There are, of course, many other water soluble forms, e.g., most of the nitrates, chlorides, formates, acetates and the like. Solubility of a given additive is readily checked in a chemical handbook.

This invention solves a long standing problem, which is, how can an additive be got into a fuel oil so as to be fed to the furnace with efficiency and uniformity. Past procedures have involved attempts to prepare an additive-oil suspension. This approach has not worked well. The additive frequently does not dispense well in the oil and may settle in the oil and/or enter the furnace gas stream as clumps. In the instant process, however, each droplet of water in the oil-water homogenizer carries in solution a tiny specific amount of additive.

As noted, this invention can be used only in furnaces equipped with oil-water homogenizers. However, in view of the general applicability of the invention, it may be advantageous for a furnace to install a homogenizer in order to obtain the benefits of the invention.

An oil-water homogenizer is used in the furnace to atomize the oil very quickly, thereby facilitating combustion. The water, being distributed as very fine droplets within the continuous oil phase, is almost instantly vaporized when the fuel enters the furnace and the consequent great increase in volume "explodes" the oil into fine droplets which quickly ignite. Any of the conventional commercial homogenizers can be used in this invention. The amount of water used is about 2–10% of the oil flow. When we add our additive, the same total amount of water is used, including any added with our additive. Typical of commercially available homogenizers are those available from Gaulin Corporation of Everett, Mass.

"Fireside additives" are well known per se, and they are added to the furnace for a wide range of well known purposes, e.g., to improve combustion: or to reduce emissions, slagging, deposits or corrosion. The instant invention is not directed to the fireside additive per se, but rather to a novel method of getting the additive into the furnace flame.

In the prior art there are three main approaches for accomplishing such addition:

1. Oil-soluble organo-metallic chemicals, e.g. copper naphthenate, which are expensive.
2. Oil-based slurries, e.g. magnesium oxide slurried in #2 fuel oil. These are difficult to stabilize and may settle in the drum.
3. Emulsions, in which oil is the continuous phase, with aqueous salt solutions emulsified into the oil (see Canadian Pat. No. 976,755). These emulsions are not, in our experience, completely stable.

Our invention dispenses completely with any oil in the treatment: we feed the additive in water to the oil being used to fire the boiler.

Preferably, a feed solution of the additive in water is made up, and this is metered to the water fed to the homogenizer. However, it is possible to feed directly to the oil line ahead of the homogenizer.

EXAMPLE 1

The invention is used by a steel producer in two blast furnaces. A water solution of 10% copper sulfate and 20% manganese sulfate is fed at the rate of one gallon per 4000 gallons of residual fuel oil to each of the furnaces. The steel company produces 4500 tons per day of iron from these two furnaces, using 110,000 gallons of oil and requiring a total of about 26 gallons of treating solution. A Gaulin homogenizer mixes the oil with 3300 gallons of water (3% based on the oil) or about 1 gallon of solution per 127 gallons of homogenizing water. The treating solution is fed into the latter water. In these two furnaces the carbon sources are fuel oil and coke, with the oil the less expensive of the two. In the additive, the copper sulfate functions in the known way, namely, as a carbon ignition temperature depressant, and the manganese sulfate in its known way, namely, as a combustion catalyst. In addition, the use of the additive allows a greater proportion of oil (to coke) to be used.

Although the above example is specific to a blast furnace, the invention is broadly applicable to any oil-fired furnace. It has particular utility in oil-fired utility boilers.

A large utility boiler, e.g., 500 megawatts, may burn about 180,000 lbs. fuel oil/hour, via several burners, each fed by an oil-water homogenizer. This invention can be used to feed additive into one or more of such homogenizers.

The invention is not limited to the use of oil-water homogenizers. It is also applicable to homogenizers for dispersion of sludge and carbonaceous materials.

Suitably, the total water going into the homogenizer, including that with the additive, is about 0.2–10% by volume of the oil, and the additive solution is about 0.01–20% by volume of the total water.

We claim:

1. The method of introducing a water-soluble fireside additive into an oil-fired furnace equipped with a homogenizer, fuel feed comprising adding the additive as an aqueous solution into the homogenizer.

2. Method according to claim 1 in which the total water going into the homogenizer, including that with the additive, is about 0.2 to 10% by volume of the oil.

3. Method according to claim 2 in which the additive solution is about 0.01 to 20% by volume of the total water.

4. Method according to claim 1 in which the additive is a member selected from the group consisting of a salt of Mn, Cu, Mg, Al, Fe, Pb, Zn, and mixes thereof.

5. Method according to claim 4 in which the salt is a sulfate.

6. Method according to claim 5 in which the additive is a mixture of 10% copper sulfate and 20% manganese sulphate in water, added at the rate of one gallon of said solution per 4000 gallons of oil to the furnace.

7. Method according to claim 6 in which the solution of additive is added to water in the homogenizer in gallons at the rate of about 1:127.

8. Method according to claim 4 in which the additive: total water weight ratio is about 3:7.

* * * * *